US011709447B2

(12) United States Patent
Kikuchi

(10) Patent No.: US 11,709,447 B2
(45) **Date of Patent: *Jul. 25, 2023**

(54) HEATER UNIT, FIXING DEVICE, AND IMAGE FORMING APPARATUS

(71) Applicant: TOSHIBA TEC KABUSHIKI KAISHA, Tokyo (JP)

(72) Inventor: Kazuhiko Kikuchi, Yokohama Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/868,540

(22) Filed: Jul. 19, 2022

(65) Prior Publication Data

US 2022/0350279 A1 Nov. 3, 2022

Related U.S. Application Data

(63) Continuation of application No. 17/318,758, filed on May 12, 2021, now Pat. No. 11,422,492.

(30) Foreign Application Priority Data

Sep. 1, 2020 (JP) ..... 2020-146883

(51) Int. Cl.
*G03G 15/20* (2006.01)

(52) U.S. Cl.
CPC ..... *G03G 15/205* (2013.01); *G03G 15/2053* (2013.01); *G03G 15/2064* (2013.01)

(58) Field of Classification Search
CPC ..... G03G 15/2064; G03G 15/2042; G03G 15/205; G03G 15/2053
See application file for complete search history.

(56) References Cited

U.S. PATENT DOCUMENTS

| | | | |
|---|---|---|---|
| 5,171,969 | A | 12/1992 | Nishimura et al. |
| 6,272,308 | B1 | 8/2001 | Maeda et al. |
| 9,261,832 | B2 | 2/2016 | Muramatsu et al. |
| 2004/0256372 | A1 | 12/2004 | Yoshioka et al. |
| 2009/0230114 | A1 | 9/2009 | Taniguchi et al. |
| 2011/0081157 | A1 | 4/2011 | Mitsuoka et al. |
| 2011/0129268 | A1 | 6/2011 | Ishii et al. |
| 2011/0194870 | A1 | 8/2011 | Hase et al. |
| 2011/0206427 | A1 | 8/2011 | Iwaya et al. |
| 2011/0222888 | A1 | 9/2011 | Ikebuchi et al. |
| 2011/0229181 | A1 | 9/2011 | Iwaya et al. |
| 2012/0213540 | A1 | 8/2012 | Igarashi |
| 2012/0308280 | A1 | 12/2012 | Tsuruya et al. |
| 2013/0108306 | A1 | 5/2013 | Saito et al. |
| 2013/0336672 | A1 | 12/2013 | Mizuta et al. |

(Continued)

*Primary Examiner* — Sevan A Aydin
(74) *Attorney, Agent, or Firm* — Kim & Stewart LLP

(57) ABSTRACT

According to an embodiment, a heater unit includes a substrate. A first heating element is on a first side of the substrate. A second heating element is on a second side of the substrate. A first wiring is on the first side of the substrate and connected to the first heating element. A first electrode is on the first side of the substrate and connected to the first heating element. A second wiring is on the second side of the substrate and connected to the second heating element. A second electrode is on the second side of the substrate and connected to the second heating element via the second wiring. A portion of the second heating element overlaps a first portion of the first heating element.

20 Claims, 9 Drawing Sheets

(56) References Cited

U.S. PATENT DOCUMENTS

| | | | |
|---|---|---|---|
| 2015/0139708 | A1 | 5/2015 | Shimura et al. |
| 2016/0238974 | A1 | 8/2016 | Kadowaki |
| 2017/0185016 | A1 | 6/2017 | Kadowaki |
| 2017/0363995 | A1 | 12/2017 | Takagi |
| 2017/0363998 | A1 | 12/2017 | Takagi |
| 2019/0171136 | A1 | 6/2019 | Iwasaki et al. |
| 2019/0250539 | A1 | 8/2019 | Takagi |

HEATER UNIT, FIXING DEVICE, AND IMAGE FORMING APPARATUS

CROSS-REFERENCE TO RELATED APPLICATIONS

This application is a continuation of U.S. patent application Ser. No. 17/318,758, filed May 12, 2021, which is based upon and claims the benefit of priority from Japanese Patent Application No. 2020-146883, filed Sep. 1, 2020, the entire contents of each of which are incorporated herein by reference.

FIELD

Embodiments of the present disclosure relate generally to a heater unit, a fixing device incorporating a heater unit, and an image forming apparatus incorporating a fixing device.

BACKGROUND

Conventionally, an electrophotographic image forming apparatus includes a fixing device that heats toner to fix the toner to a sheet. As a fixing device of such an image forming apparatus, there is a type of fixing device that includes a heater unit with a plurality of heating elements arranged in a row on a substrate along a sheet width direction. In such a fixing device, it is necessary to include a large number of wires on the substrate for supplying power to the different heating elements.

DETAILED DESCRIPTION

Figure 1:
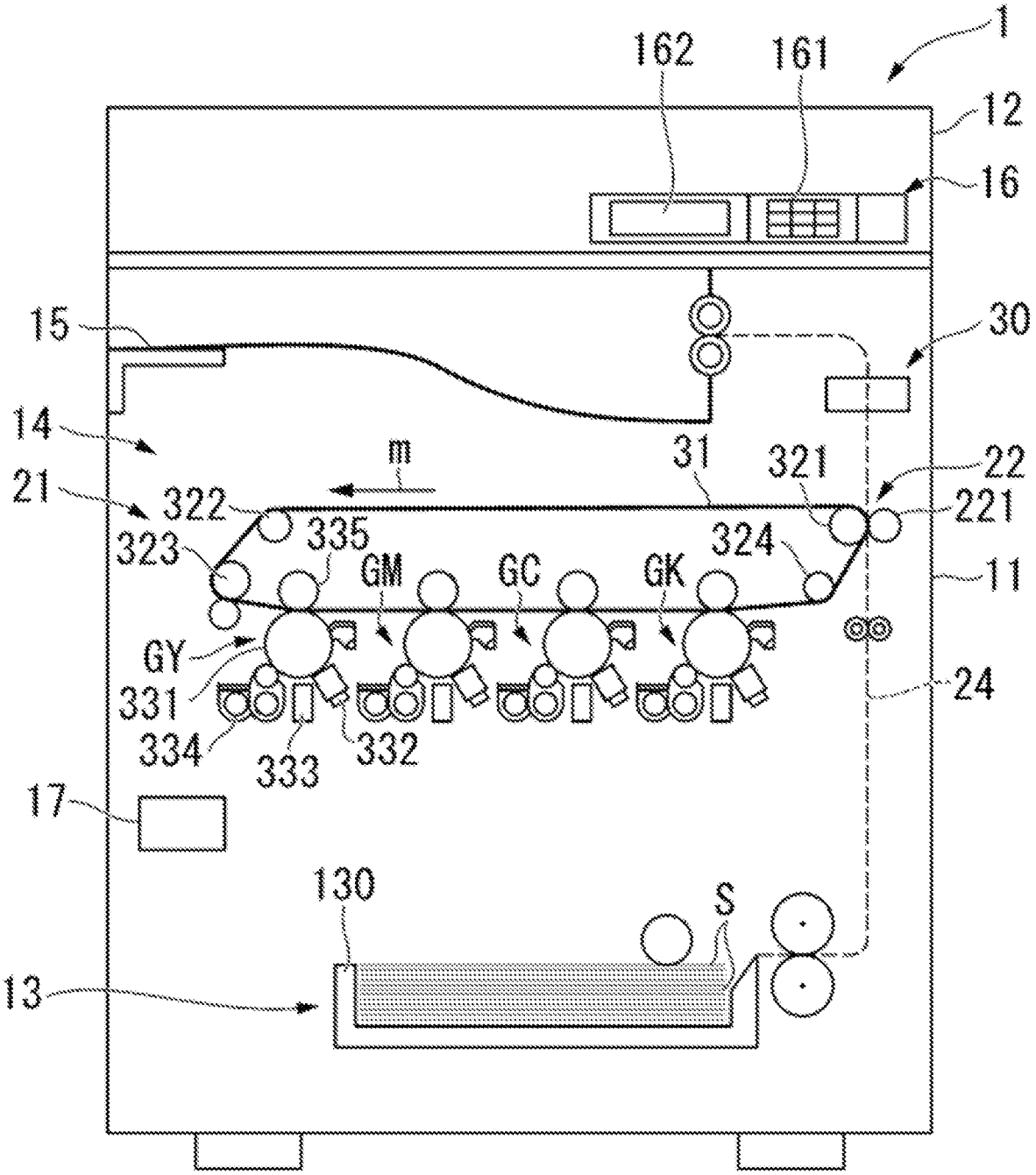
FIG. 1 depicts an overall configuration of an image forming apparatus according to a first embodiment.

In general, according to one embodiment, a heater unit includes a substrate. A first heating element is on a first side of the substrate. A second heating element is on a second side of the substrate. The second side is opposite the first side. A first wiring is on the first side of the substrate and connected to the first heating element. A first electrode is on the first side of the substrate and connected to the first heating element. A second wiring is on the second side of the substrate and connected to the second heating element. A second electrode is on the second side of the substrate and connected to the second heating element via the second wiring. A portion of the second heating element overlaps a first portion of the first heating element.

Hereinafter, a heater unit, a fixing device, and an image forming apparatus according to certain example embodiments will be described with reference to the drawings.

In the drawings, the same or corresponding components are denoted by the same reference numerals unless otherwise specified.

First Embodiment

FIG. 1 depicts an image forming apparatus 1 according to an embodiment. For example, the image forming apparatus 1 is a multifunction peripheral (MFP) apparatus. However, the image forming apparatus 1 is not limited this, and may be a copier, a printer, or the like. As illustrated in FIG. 1, the image forming apparatus 1 includes a housing 11, a scanner unit 12, a sheet supply unit 13, a printer unit 14, a sheet discharge part 15, and a control panel 16.

The housing 11 forms an outside of the image forming apparatus 1. The housing 11 accommodates therein a scanner unit 12, a sheet supply unit 13, and a printer unit 14.

The scanner unit 12 reads an image on a document or the like as brightness and darkness of reflected light or the like. The scanner unit 12 generates and records image information indicating the image read from the document. The scanner unit 12 outputs the generated image information to the printer unit 14. The recorded image information may also or instead be transmitted to an external apparatus or the like via a network.

The sheet supply unit 13 supplies sheets S, which are sheet-shaped recording media such as paper, one by one to a conveyance path 24 in accordance with the timing at which the printer unit 14 forms a toner image. The sheet supply unit 13 includes a sheet feeding cassette part 130 for accommodating the sheet S. The sheet supply unit 13 supplies a particular sheet S from the sheet feeding cassette part 130 to the conveyance path 24 in response to a command from the control unit 17.

The printer unit 14 forms a toner image on the sheet S conveyed by the sheet supply unit 13. The printer unit 14 forms a toner image on the sheet S using a recording material such as toner. The toner image is based on image information acquired from the scanner unit 12 or an external device.

In the present embodiment, the printer unit 14 of an intermediate transfer type will be described as an example. However, other types of an image forming apparatus such as an image forming unit of a direct transfer type may be utilized. The printer unit 14 of the present embodiment includes an intermediate transfer unit 21, a secondary transfer unit 22, a fixing device 30, and a conveyance path 24.

The intermediate transfer unit 21 includes an intermediate transfer belt 31, a plurality of rollers 321, 322, 323, and 324, and a plurality of image forming units GY, GM, GC, and GK. The intermediate transfer belt 31 is formed in a loop. The rollers 321, 322, 323, and 324 support the intermediate transfer belt 31. As a result, the intermediate transfer belt 31 may travel continuously in the direction indicated by arrow m in FIG. 1.

The image forming units GY, GM, GC, and GK include a yellow image forming unit GY, a magenta image forming unit GM, a cyan image forming unit GC, and a black image forming unit GK. Each of the image forming units GY, GM, GC, and GK includes a photosensitive drum 331, an electrostatic charger 332, an exposure unit 333, a developing device 334, and a transfer roller 335. Each image forming unit GY, GM, GC, and GK transfers a toner image from the surface of a photosensitive drum 331 to the intermediate transfer belt 31.

The secondary transfer unit 22 includes a transfer roller 221. The transfer roller 221 is in contact with the outer surface of the intermediate transfer belt 31. One belt roller 321 that supports the intermediate transfer belt 31 an corresponds to the transfer roller 221 in the secondary transfer unit 22. The sheet S passed between the transfer roller 221 and the belt roller 321 with the intermediate transfer belt 31. As a result, the toner image on the intermediate transfer belt 31 is transferred onto the sheet S.

The fixing device 30 heats and presses the toner image transferred onto the sheet S to fix the toner image onto the sheet S.

The conveyance path 24 extends from the sheet supply unit 13 to the sheet discharge part 15 and passes through the secondary transfer unit 22 and the fixing device 30. The sheet S is conveyed along the conveyance path 24 to move from the sheet supply unit 13 to the sheet discharge part 15 through the secondary transfer unit 22 and the fixing device 30. The sheet discharge part 15 discharges the sheet S on which the image is formed by the printer unit 14.

The control panel 16 includes a panel 161 and a display 162. The panel 161 receives inputs of various operation instructions. The display 162 is an image display device such as a liquid crystal display (LCD) or an organic EL (Electroluminescence) display. The display 162 displays various types of information related to the image forming apparatus 1. The display 162 displays, for example, an operation mode of the image forming apparatus 1 selected by a user. In the present embodiment, the control panel 16 corresponds to an "input unit".

The image forming apparatus 1 sets a particular operation mode according to an operation input by pressing an input button or the like on the panel 161. Alternatively, the user may specify the operation mode of the image forming apparatus 1 by performing an operation input by tapping an icon or the like displayed on a touch panel in which the display 162 and the panel 161 are integrally configured, for example. The control unit 17 (also referred to as a controller) controls each unit of the image forming apparatus 1.

Figure 2:
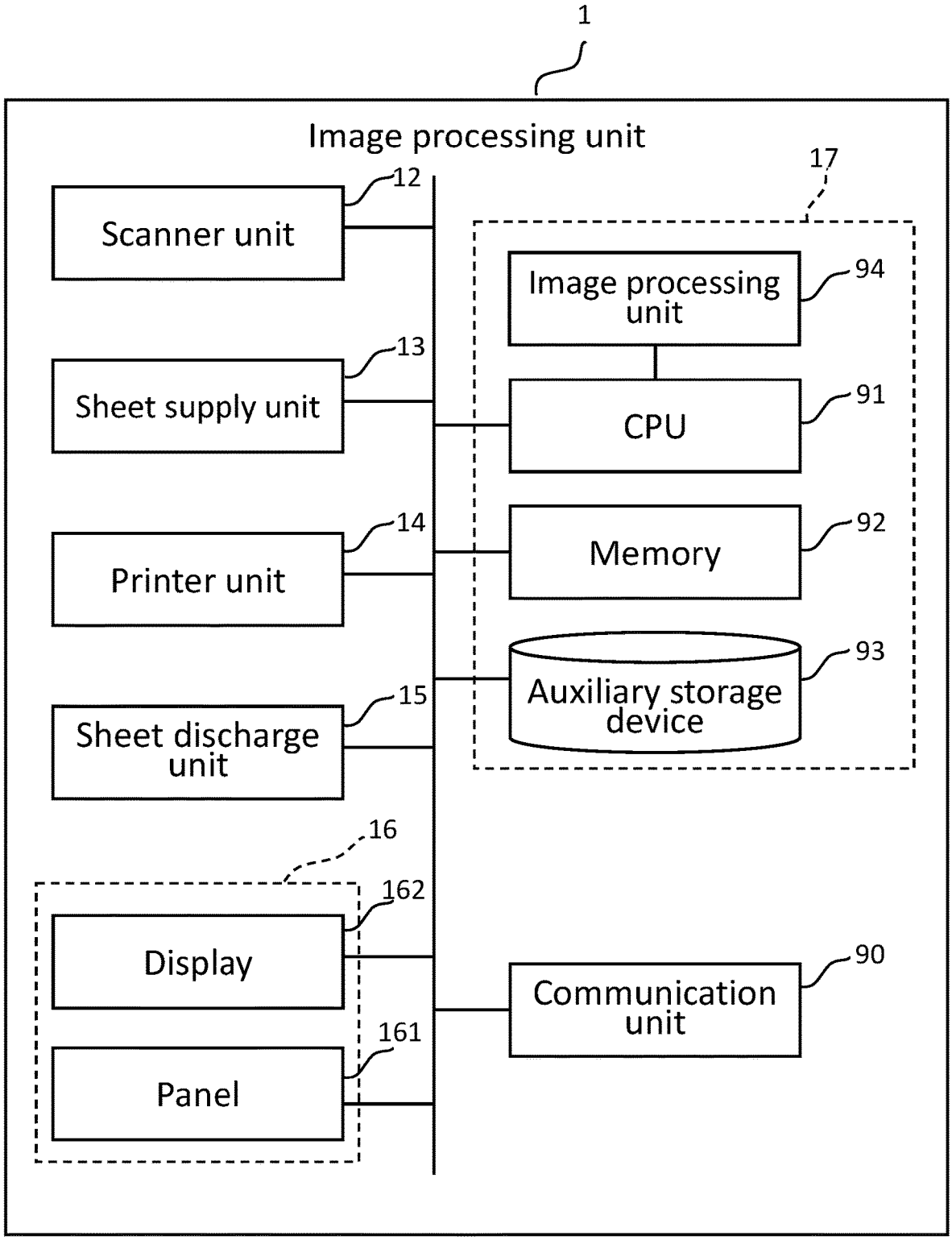
FIG. 2 depicts aspects of a hardware configuration of an image forming apparatus.

FIG. 2 is a diagram illustrating aspects of a hardware configuration of the image forming apparatus 1. The control unit 17 of the image forming apparatus 1 includes a CPU (Central Processing Unit) 91, a memory 92, an auxiliary storage device 93, and the like, and executes a program. The image forming apparatus 1 provides the functions of a scanner unit 12, a sheet supply unit 13, a printer unit 14, a sheet discharge part 15, a control panel 16, and a communication unit 90 by execution of a software program. In some examples, some or all of the described functions of the image forming apparatus 1 may be implemented by hardware such as ASIC (Application Specific Integrated Circuit), PLD (Programmable Logic Device), or FPGA (Field Programmable Gate Array). The program may be recorded in a non-transitory computer-readable recording medium. The computer-readable recording medium is, for example, a portable medium such as a flexible disk, a magneto-optical disk, or a ROM, CD-ROM, or a storage device such as a hard disk incorporated in the computer system. The program may be transmitted via a telecommunication line or the like.

In general, the CPU 91 provides various functions of the control unit 17 by executing one or more programs stored in the memory 92 and/or the auxiliary storage device 93. The control unit 17 controls the operation of the various functional units of the image forming apparatus 1. The control unit 17 also includes an image processing unit 94. The image processing unit 94 can be connected to the CPU 91. The auxiliary storage device 93 is a storage device such as a magnetic hard disk device or a solid-state semiconductor storage device. The auxiliary storage device 93 stores various types of information related to the image forming apparatus 1. The communication unit 90 includes a communication interface for connecting to an external apparatus. The communication unit 90 communicates with the external device via the communication interface.

Figure 3:
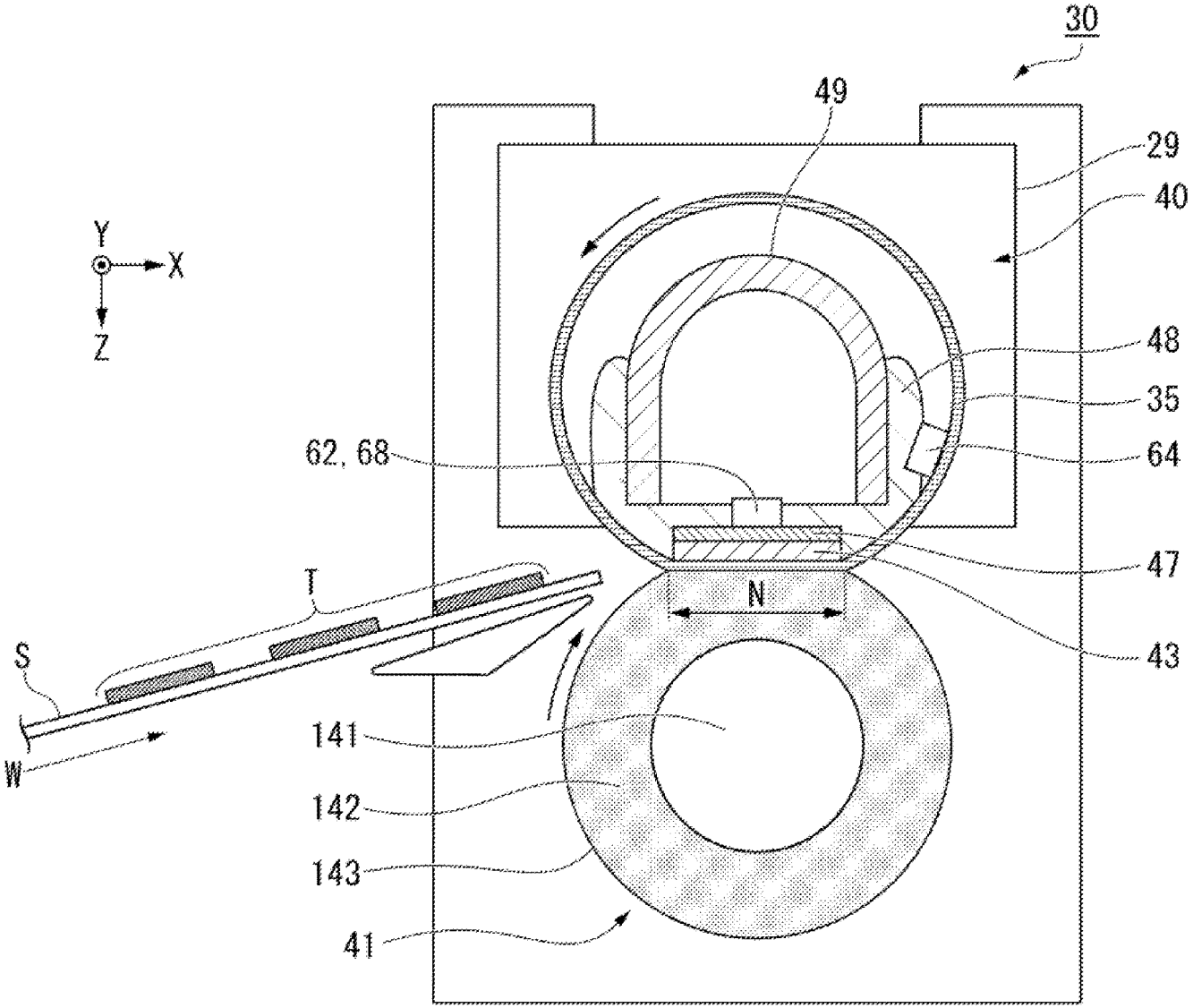
FIG. 3 is a cross-sectional view of a fixing device.

FIG. 3 is a cross-sectional view of the fixing device 30. The fixing device 30 includes a fixing belt unit 40 and a pressure roller 41. As shown in FIG. 3, the fixing belt unit 40 forms a nip N with the pressure roller 41. The fixing belt unit 40 heats a toner image T on the sheet S that has entered the nip N. The fixing belt unit 40 includes a fixing belt 35, a heater unit 43, a first temperature detection unit 62, a thermostat 68, a second temperature detection member 64, a heat conduction member 47, a support member 48, and a stay 49.

Hereinafter, a configuration of the fixing device 30 will be described using an XYZ coordinate system. In the present description, the X direction, the Y direction, and the Z direction are defined as follows. The X direction corresponds to a direction along the short direction of the heater unit 43. The Y direction corresponds to a direction along the longitudinal direction (corresponding to the sheet width direction) of the fixing belt unit 40 and the pressure roller 41. In the present embodiment, the Y direction is orthogonal to the conveyance direction W of the sheet S. The Z direction corresponds to a direction orthogonal to the X direction and the Y direction. Hereinafter, for the X axis, one direction is referred to as a +X side, and the other direction is referred to as a −X side. For the Y axis, one direction is referred to as a +Y side, and the other direction is referred to as a −Y side. In the Z axis, one direction is referred to as a +Z side, and the other direction is referred to as a −Z side.

The fixing belt 35 is a closed loop shape. The fixing belt 35 can be formed of a film-like cylindrical body or drum. The fixing belt 35 includes a base layer, an elastic layer, and a release layer in this order from the inner circumferential side of the loop. The elastic layer is on the outer peripheral surface of the base layer. The elastic layer is formed of an elastic material such as rubber. The release layer is on the outer peripheral surface of the elastic layer. The release layer is formed of a material such as PFA resin.

The heater unit 43 is disposed inside the closed loop of the fixing belt 35 on an inner surface thereof. The heater unit 43 heats the fixing belt 35. The fixing belt 35 is heated by the heater unit 43 to fix the toner image T to the sheet S.

In FIG. 3, the heater unit 43 is depicted as disposed within the loop of the fixing belt 35. A lubricant is typically applied to the inner circumferential surface of the fixing belt 35. The heater unit 43 is in contact with the inner circumferential surface of the fixing belt 35 via this lubricant. When the heater unit 43 generates heat, the viscosity of the lubricant decreases. The friction between the heater unit 43 and the fixing belt 35 is thus reduced with heating. The fixing belt 35 contacts and slides along the surface of the heater unit 43.

The heat conduction member 47 is formed of a metal material having high heat conductivity such as copper. The planar shape of the heat conduction member 47 is the same as the planar shape of the heater unit 43. The heat conduction member 47 is disposed in contact with the −Z side surface of the heater unit 43. The heat conduction member 47 operates to average the temperature distribution across the heater unit 43.

The support member 48 is formed of a resin material such as a liquid crystal polymer. The support member 48 is disposed so as to cover the −Z side and both ends in the X direction of the heater unit 43. The support member 48 contacts the heater unit 43 via the heat conduction member 47 in parts. Round chamfers are formed at both end of the support member 48. The support member 48 contacts and supports the inner circumferential surface of the fixing belt 35 on both ends of the heater unit 43 in the X direction.

The stay 49 is formed of a steel plate material or the like. The cross section of the stay 49 along the XZ plane is a U shape in this example. The stay 49 is attached to the −Z side of the support member 48 so that the opening of the U shape is closed by the support member 48. The stay 49 extends in the Y direction. Both end parts of the stay 49 in the Y direction are fixed to the housing 11 of the image forming apparatus 1 or the like. Thus, the fixing belt unit 40 is thus mechanically supported by the image forming apparatus 1. The stay 49 improves rigidity of the fixing belt unit 40 and helps prevent bending or flexing. Flanges 29 for restricting the movement of the fixing belt 35 in the Y direction are mounted near both end parts of the stay 49 in the Y direction.

The pressure roller 41 applies pressure to the toner image T on the sheet S that has entered the nip N. The pressure roller 41 also rotates and conveys the sheet S past the nip N. The pressure roller 41 includes a core metal 141, an elastic layer 142, and a release layer 143. The pressure roller 41 presses the surface of the fixing belt 35 and is rotatable.

The core metal 141 is formed in a cylindrical or rod shape from a metal material such as stainless steel. Both end parts of the core metal 141 in the axial direction are rotatably supported by the housing 11. The core metal 141 can be rotationally driven by a motor. The core metal 141 comes in contact with a cam member. The cam member can rotate to move the core metal 141 toward or away from the fixing belt unit 40.

The elastic layer 142 is formed of an elastic material such as silicone rubber. The elastic layer 142 is formed with a constant thickness on the outer peripheral surface of the core metal 141. The release layer 143 is formed of a resin material such as a PFA type material (e.g., a tetrafluoroethylene-perfluoroalkyl vinyl ether copolymer). The release layer 143 is formed on the outer peripheral surface of the elastic layer 142. The hardness of the outer circumferential surface of the pressure roller 41 is preferably 40 to 70 degrees under a load of 9.8 N (newtons) as measured by an ASKER-C hardness meter. This ensures the appropriate area of the nip N and the durability of the pressure roller 41.

As noted, the pressure roller 41 can approach and separate from the fixing belt unit 40 by rotation of a cam member. When the pressure roller 41 is brought close to the fixing belt unit 40 and pressed by the pressure spring, a nip N is formed. On the other hand, when a jam of the sheet S occurs in the fixing device 30, the sheet S can be removed by separating the pressure roller 41 from the fixing belt unit 40. Furthermore, when the rotation of the fixing belt 35 is stopped, such as during a device sleep or idle mode, the pressure roller 41 can be separated from the fixing belt unit 40, thereby preventing the fixing belt 35 from being plastically deformed.

The pressure roller 41 is rotationally driven by a motor. When the pressure roller 41 rotates in a state where the nip N is formed, the fixing belt 35 of the fixing belt unit 40 is also driven to rotate. The pressure roller 41 conveys the sheet S in the conveyance direction W by rotating.

Figure 4:
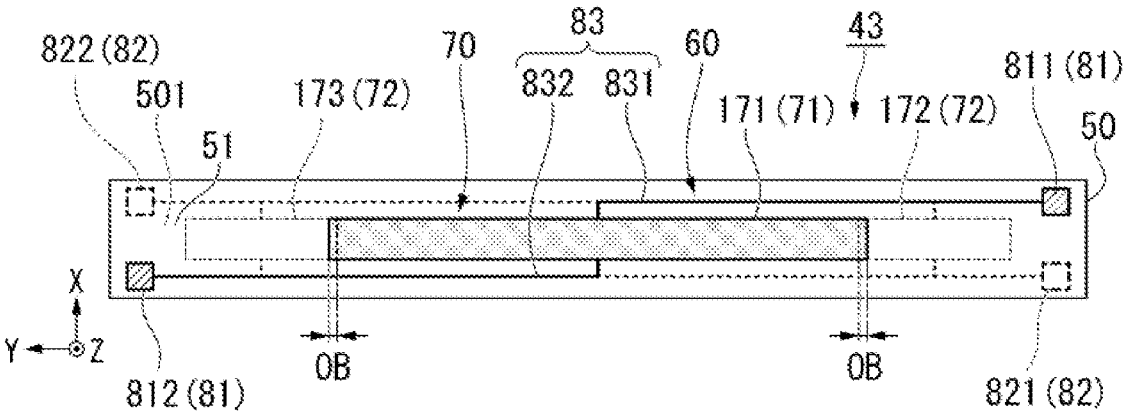
FIG. 4 is a top view of a heater unit according to a first embodiment.
Figure 5:
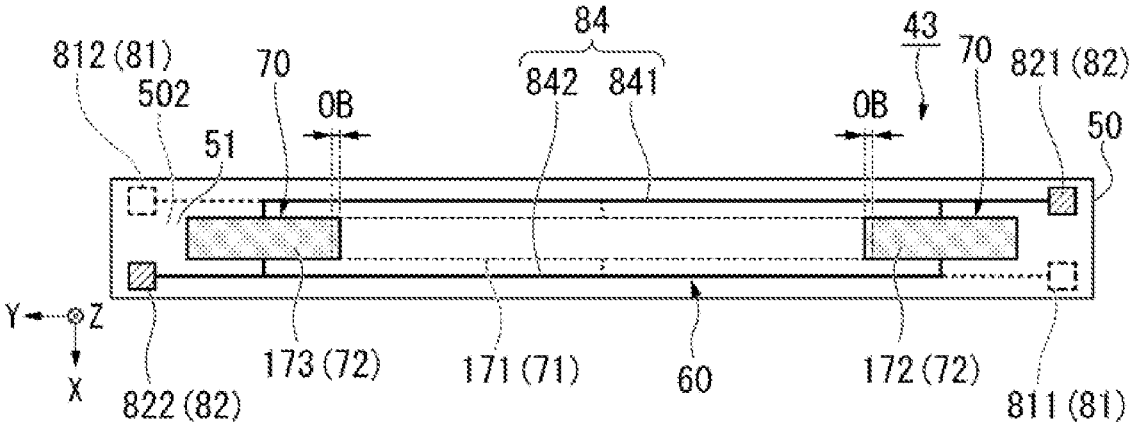
FIG. 5 is a bottom view of a heater unit according to a first embodiment.
Figure 6:
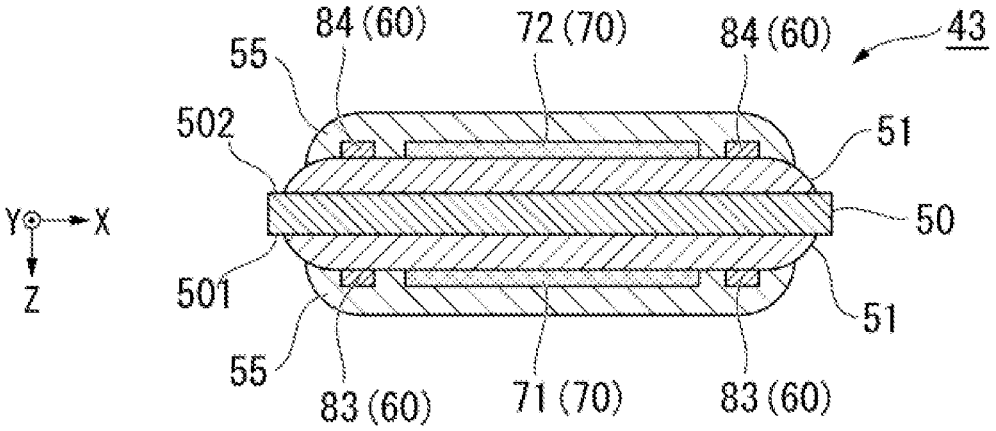
FIG. 6 is a cross-sectional view of a heater unit.

FIGS. 4 and 5 are plan views of the heater unit 43. FIG. 6 is a cross-sectional view of the heater unit 43. FIG. 4 is a top view of the heater unit 43 as viewed from the +Z side toward the −Z side, and FIG. 5 is a bottom view of the heater unit 43 as viewed from the −Z side toward the +Z side. FIG. 6 is a cross-sectional view of the heater unit 43 taken along a plane parallel to the XZ plane.

As shown in FIGS. 4 and 5, the heater unit 43 includes a base 50, a heat generating member 70, and a wiring group 60. The base 50 is formed of a metal material such as stainless steel or a ceramic material such as aluminum nitride. The base 50 is formed in a long rectangular plate shape along the Y axis. The base 50 is disposed on the inner side (−Z side) in the radial direction of the fixing belt 35. The longitudinal direction of the base 50 is the axial direction of the fixing belt 35.

As shown in FIG. 6, the base 50 has a first surface 501 and a second surface 502 facing opposite directions. The base may be referred to as a heater unit substrate or more simply as a substrate in some instances. The first surface 501 is facing in the +Z direction, and the second surface 502 is facing in the −Z direction. An insulating layer 51 made of a glass material or the like is formed on the first surface 501 and the second surface 502 of the base 50. In the heater unit 43 of the present embodiment, the first surface 501 side of the base 50 is in contact with the inner peripheral surface of the fixing belt 35.

The heat generating member 70 and the wiring group 60 are disposed on the base 50 via the insulating layer 51. The heat generating member 70 and the wiring group 60 are covered with a protective layer 55 made of a glass material or the like. The protective layer 55 improves slidability (reduces friction) between the heater unit 43 and the fixing belt 35. In FIGS. 4 and 5, specific illustration of the protective layer 55 has been omitted.

As shown in FIGS. 4 and 5, the heat generating member 70 includes a first heat generator 71 provided on the first surface 501 via the insulating layer 51, and a second heat generator 72 provided on the second surface 502 via the insulating layer 51. The first heat generator 71 and the second heat generator 72 are formed of a so-called temperature coefficient of resistance material ("TCR material") that changes in electrical resistance with changes temperature. For example, the first heat generator 71 and the second heat generator 72 are formed of a silver-palladium alloy or the like. The first heat generator 71 and the second heat generator 72 may each be referred to as a heating elements or heating element groups in some instances.

In the present example, the first heat generator 71 includes a central heating element 171. The central heating element 171 is located at the center of the first surface 501 of the base 50. In the present embodiment, the central heating element 171 is provided on the first surface 501 side of the heater unit 43 that is in contact with the fixing belt 35.

The outer planar shape of the central heating element 171 is a rectangular shape having a one side (a longer side) along the Y direction and another side (shorter side) along the X direction. The central heating element 171 is disposed along the longitudinal (length) direction of the base 50. For the present embodiment, the central heating element 171 may be referred to as a first heating element in some instances.

In the present example, the second heat generator 72 includes a first end heating element 172 and a second end heating element 173. The first end heating element 172 and the second end heating element 173 are provided on the second surface 502 of the base 50. In the present embodiment, the first end heating element 172 and the second end heating element 173 are provided on the second surface 502 side of the heater unit 43.

The outer planar shape of each of the first end heating element 172 and the second end heating element 173 is a rectangular shape having one side (the longer side) along the Y direction and another side (the shorter side) along the X direction. The individual dimensions of the first end heating element 172 and the second end heating element 173 in the Y direction are less than the dimension of the central heating element 171 in the Y direction. The individual dimensions of the first end heating element 172 and the second end heating element 173 in the X direction are equal to the dimension of the central heating element 171 in the X direction. In the present embodiment, the first end heating element 172 and the second end heating element 173 may each be referred to as a second heating element in some instances.

When the heater unit 43 is viewed in plan in the thickness direction of the base 50, that is, in the Z direction of the heater unit 43, the first heat generator 71 and the second heat generator 72 are arranged along the longitudinal direction of the base 50. Hereinafter, the plan view of the heater unit 43 from a Z direction is simply referred to as "in a plan view".

In a plan view, the first end heating element 172 and the second end heating element 173 are aligned along the longitudinal direction (Y direction) of the base 50. The first end heating element 172 is disposed at the end on the −Y side of the second surface 502 of the base 50. The second end heating element 173 is disposed at the end on the +Y side of the second surface 502 of the base 50. The first end heating element 172 is provided to the −Y side of the central heating element 171, and the second end heating element 173 is provided to the +Y side of the central heating element 171. The first end heating element 172 and the second end heating element 173 are positioned on the outer end (+Y side or −Y side) in the longitudinal direction of the base 50 with the central heating element 171 between.

In a plan view, the first heat generator 71 and the second heat generator 72 partially overlap each other. The first end heating element 172 and the central heating element 171 partially overlap each other in the longitudinal direction of the base 50. The second end heating element 173 and the central heating element 171 partially overlap each other in the longitudinal direction of the base 50. An overlap amount OB between the first end heating element 172 and the central heating element 171 is equal to an overlap amount OB between the second end heating element 173 and the central heating element 171.

In the heater unit 43 of the present embodiment, the first heat generator 71 and the second heat generator 72 are disposed in an overlapping state, and thus it is possible to prevent the occurrence of a temperature drop at the boundary between the heat generators 71 and 72. The overlap amount OB is preferably less than or equal to 10 mm, but more preferably less than or equal to 5 mm. By setting the overlap amount OB within this range, it is possible to prevent the temperature at the boundary between the heating elements from becoming too high which might otherwise occur if the overlap amount OB is too large.

In the heater unit 43, since the first end heating element 172 and the second end heating element 173 are formed in a distributed manner on both surfaces of the base 50, it is possible to realize a structure in which the first heat generator and the second heat generator 72 are disposed in an overlapping state in plan view as described above.

The wiring group 60 is formed of a metal material such as silver. The wiring group 60 includes a first electrode group 81, a second electrode group 82, a first wiring portion 83, and a second wiring portion 84.

The first electrode group 81 and the first wiring portion 83 are provided on the first surface 501 of the base 50 via the insulating layer 51. The first electrode group 81 supplies electric power to the first heat generating portion 71 via the first wiring portion 83. The electrodes of the first electrode group 81 are disposed near the ends of the base 50 in the longitudinal direction.

More particularly, the first electrode group 81 includes a positive electrode 811 and a common electrode 812. The positive electrode 811 is disposed at near the −Y side and the +X side corner of the base 50. The common electrode 812 is disposed at near the +Y side and the −X side corner of the base 50.

The first wiring portion 83 includes a positive wiring 831 and a common wiring 832. The positive wiring 831 is connected to the +X side of the central heating element 171 and extends along the −Y side. The positive wiring 831 connects the central heating element 171 and the positive electrode 811. The common wiring 832 is connected to the −X side of the central heating element 171 and extends along the +Y side. The common wiring 832 connects the central heating element 171 and the common electrode 812.

The second electrode group 82 and the second wiring portion 84 are provided on the second surface 502 via the insulating layer 51. The second electrode group 82 supplies electric power to the second heat generator 72 via the second wiring portion 84. The electrodes of the second electrode group 82 are provided near the ends of the base 50 in the longitudinal direction.

More particularly, the second electrode group 82 includes a positive electrode 821 and a common electrode 822. The positive electrode 821 is disposed near the −Y side and the −X side corner of the base 50. The common electrode 822 is disposed near the +Y side and the +X side corner of the base 50.

The second wiring portion 84 includes a positive wiring 841 and a common wiring 842. The positive wiring 841 is disposed on the −X side of the first end heating element 172 and the second end heating element 173. The positive wiring 841 is connected to the −X side of the first end heating element 172 and the second end heating element 173, and extends along the −Y side. The positive wiring 841 connects the first end heating element 172 and the second end heating element 173 to the positive electrode 821. The common wiring 842 is connected to the +X side of the first end heating element 172 and the second end heating element 173, and extends along the +Y side. The common wiring 842 connects the first end heating element 172 and the second end heating element 173 to the common electrode 822.

In the heater unit 43, the first heat generator 71 and the second heat generator 72 of the heat generating member 70 are on opposite surfaces of the base 50. Thus, only the first electrode group 81 and the first wiring portion 83 connected to the first heat generator 71 are formed on the first surface 501. Only the second electrode group 82 and the second wiring portion 84 connected to the second heat generator 72 are formed on the second surface 502.

In plan view, the first electrode group 81 and the second electrode group 82 are disposed at positions that are not overlapping each other. In this first embodiment, the positive electrode 811, the common electrode 812, the positive electrode 821, and the common electrode 822 are particularly disposed at different corner parts of the base 50.

In the first embodiment, the heat generating member 70 generates heat when supplied with electric current. The electrical resistance value of the central heating element 171 is smaller than the electrical resistance values of the first end heating element 172 and the second end heating element 173. In this first embodiment, a sheet S having a small width in the Y direction can pass through just the central part of the fixing device 30. In such a case, the control unit 17 can cause just the central heating element 171 to generate heat.

On the other hand, for a sheet S having a large width in the Y direction, the control unit 17 causes the entire heat generating member 70 (that is, the central heat generating element 171, the first end heat generating element 172, and the second end heat generating element 173) to generate heat.

In the first embodiment, the heat generation of the central heating element 171, the first end heating element 172, and the second end heating element 173 can be controlled independently of each other. The heat generation of the first end heating element 172 and the second end heating element 173 can be similarly controlled as one another.

Figure 7:
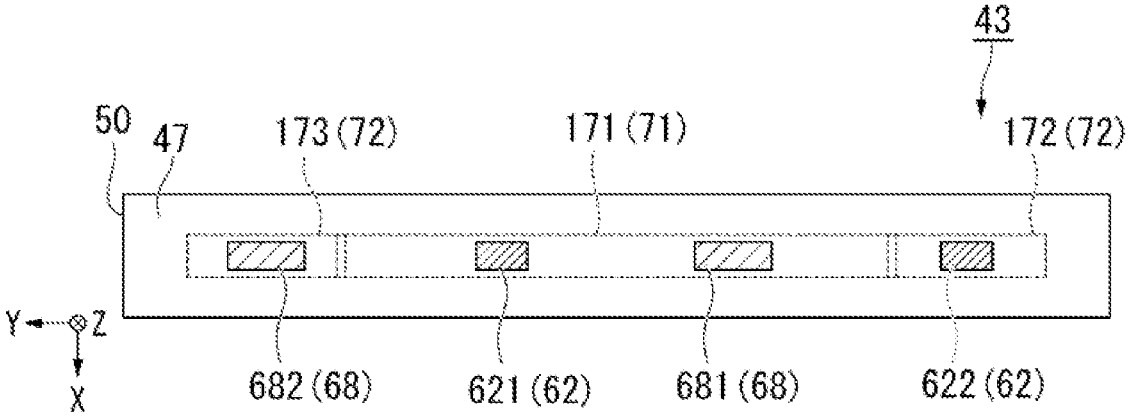
FIG. 7 is a plan view of a first temperature detection unit and a thermostat unit.

FIG. 7 is a plan view (a view seen from the −Z side) of the first temperature detection unit 62 and the thermostat 68. In FIG. 7, illustration of the support member 48 is omitted.

As shown in FIG. 7, the first temperature detection unit 62 is disposed on the −Z side of the heater unit 43 with the heat conduction member 47 interposed therebetween. For example, the first temperature detection unit 62 is a thermistor. The first temperature detection unit 62 is attached to, and supported by, the −Z side surface of the support member 48. The temperature sensitive element of the first temperature detection unit 62 passes through a hole penetrating the support member 48 in the Z direction and comes into contact with the heat conduction member 47. The first temperature detection unit 62 thus measures the temperature of the heater unit 43 via the heat conduction member 47.

The first temperature detection unit 62 includes a central heater thermometer 621 and an end heater thermometer 622 arranged spaced from each other in the Y direction. The central heater thermometer 621 and the end heater thermometers 622 are disposed within the length of the heat generating member 70 along the Y direction. The central heater thermometer 621 and the end heater thermometers 622 are disposed at the center in the X direction of the heat generating member 70. When viewed from the Z direction, the central heater thermometer 621 and the end heater thermometers 622 at least partially overlap the heat generating member 70.

In the first temperature detection unit 62, the central heater thermometer 621 measures the temperature of the central heating element 171. The central heater thermometer 621 is disposed within the length of the central heating element 171. When viewed from the Z direction, the central heater thermometer 621 and the central heating element 171 overlap each other.

In the first temperature detection unit 62, the end heater thermometer 622 measures the temperature of the first end heating element 172. Since the heat generation of the first end heating element 172 and the second end heating element 173 can be similarly controlled by the control unit 17, the temperature of the first end heating element 172 can be assumed to be equal to the temperature of the second end heating element 173 when these end heating elements are controlled in the same manner. The end heater thermometer 622 is disposed within the length of the first end heating element 172. When viewed from the Z direction, the end heater thermometer 622 and the first end heating element 172 overlap each other. Another end heater thermometer 622 for measuring the temperature of the second end heating element 173 may be provided separately in some embodiments.

When the temperature of the heater unit 43 detected via the heat conduction member 47 exceeds a predetermined temperature, the thermostat 68 cuts off power to the heat generation member 70. The thermostat 68 includes a central thermostat 681 and an end thermostat 682. The thermostat 68 is also disposed in a similar manner as the first temperature detection unit 62 described above.

When the temperature of the central heating element 171 exceeds a predetermined temperature, the central thermostat 681 cuts off power to the heat generating member 70. The central thermostat 681 is disposed within the length of central heating element 171. When viewed from the Z direction, the central thermostat 681 and the central heating element 171 overlap each other.

When the temperature of the second end heating element 173 exceeds a predetermined temperature, the end thermostat 682 cuts off power to the heat generating member 70. Since the first end heating element 172 and the second end heating element 173 are similarly controlled in this example to generate heat, the temperature of the first end heating element 172 can be considered to be equal to the temperature of the second end heating element 173. The end thermostat 682 is disposed within the length second end heating element 173. When viewed from the Z direction, the end thermostat 682 and the second end heating element 173 overlap each other.

In the heater unit 43, the central heater thermometer 621 and the central thermostat 681 are disposed within the length of the central heating element 171, whereby the temperature of the central heating element 171 can be controlled. In addition, in the heater unit 43, the end heater thermometer 622 and the end thermostat 682 are disposed within the length of the first end heating element 172 and the second end heating element 173, so that temperature control of the first end heating element 172 and the second end heating element 173 can be performed.

As illustrated in FIG. 3, the second temperature detection member 64 is disposed on the +X side inside the fixing belt 35. The second temperature detection member 64 is in contact with the inner circumferential surface of the fixing belt 35 to measure the temperature of the fixing belt 35.

Figure 8:
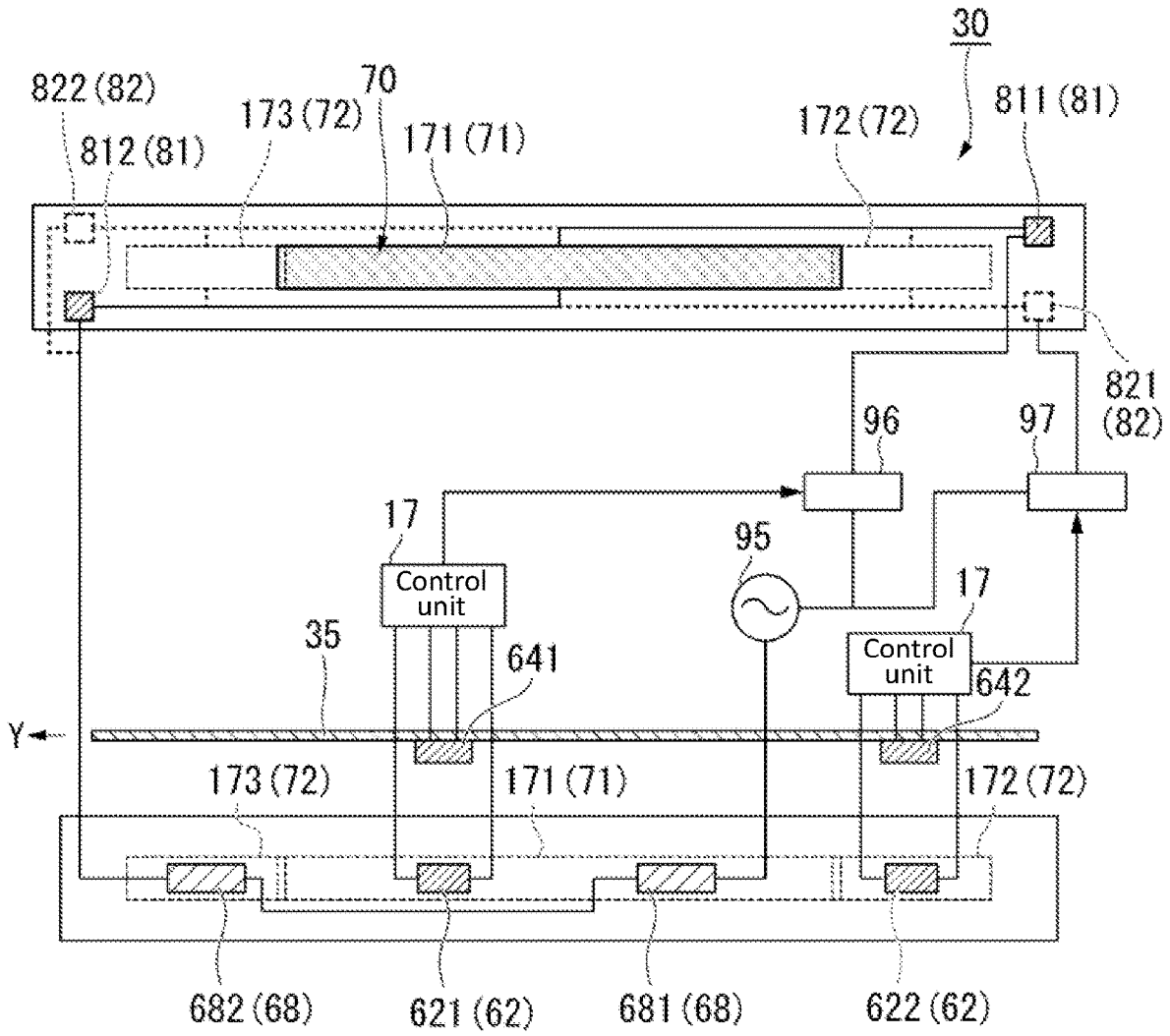
FIG. 8 is diagram of electrical connections in a fixing device.

FIG. 8 is an electric circuit diagram of a fixing device 30. In FIG. 8, the plan view of FIG. 4 is shown in the upper portion of the figure, and the plan view of FIG. 7 is shown in the lower portion of the figure. Furthermore, in FIG. 8, components of second temperature detecting member 64 are shown together with a cross section of the fixing belt 35 in a middle portion of the figure. The second temperature detection member 64 includes as components a central belt thermometer 641 and an end belt thermometer 642.

The central belt thermometer 641 is in contact with a central portion, along the Y direction, of the fixing belt 35. The central belt thermometer 641 contacts the fixing belt 35 within the length of the central heating element 171 in the Y direction. The central belt thermometer 641 measures the temperature of the central portion of the fixing belt 35.

The end belt thermometer 642 is in contact with the −Y side end part of the fixing belt 35. The end belt thermometer 642 contacts the fixing belt 35 within the length of the second end heating element 173 in the Y direction. The end belt thermometer 642 measures the temperature of the −Y side end part of the fixing belt 35. As described above, the first end heating element 172 and the second end heating element 173 are controlled similarly to generate heat. In this first embodiment, the temperature of the −Y side end part of the fixing belt 35 can be assumed to be equal to the temperature of the +Y side end part of the fixing belt 35.

A power supply 95 is connected to the positive electrode 811 of the first electrode group 81 via a central triac 96.

The power supply 95 is connected to the positive electrode 821 of the second electrode group 82 via an end triac 97.

The control unit 17 controls ON/OFF of the central triac 96 and the end triac 97 independently of each other.

When the control unit 17 turns on the central triac 96, the central heating element 171 is energized by the power supply 95, and the central heating element 171 generates heat. When the control unit 17 turns on the end triac 97, the first end heating element 172 and the second end heating element 173 are energized by the power supply 95, and the first end heating element 172 and the second end heating element 173 generate heat. The heat generation of the central heating element 171 can be independently controlled from the heat generation of the first end heating element 172 and the second end heating element 173. The central heating element 171, the first end heating element 172, and the second end heating element 173 are connected in parallel to the power supply 95 in this example.

The power supply 95 is connected to the common electrode 812 of the first electrode group 81 and the common electrode 822 of the second electrode group 82 via the central thermostat 681 and the end thermostat 682. The central thermostat 681 and the end thermostat 682 are connected in series. If the temperature of the central heating element 171 rises abnormally, the temperature detected by the central thermostat 681 will eventually exceed some predetermined temperature. At this point, the central thermostat 681 operates to cut off the power to the entire heat generating member 70 from the power supply 95.

When the temperature of the second end heating element 173 increases abnormally, the temperature detected by the end thermostat 682 will eventually exceed some predetermined temperature. At this point, the end thermostat 682 operates to cut off the power to the entire heat generating member 70 from the power supply 95. In the present example, the first end heating element 172 and the second end heating element 173 are controlled to generate heat in the same manner rather than independently. Therefore, when the temperature of the first end heating element 172 increases abnormally, the temperature of the second end heating element 173 can be assumed to also increase abnormally. Similarly, when the temperature of the first end heating element 172 increases abnormally, the end thermostat 682 cuts off the power to the entire heat generating member 70 from the power supply 95.

The control unit 17 measures the temperature of the central heating element 171 with the central heater thermometer 621. The control unit 17 measures the temperature of the first end heating element 172 with the end heater thermometer 622. The temperature of the first end heating element 172 is assumed to equal to the temperature of the second end heating element 173 in this example. The control unit 17 measures the temperature of the heat generating member 70 with the first temperature detection unit 62 when the fixing device 30 starts (warming up period or startup) and when returning from a temporary resting state (a sleep state or idle state return).

When the temperature of at least one of the central heating element 171 and the second end heating element 173 is lower than some predetermined temperature at startup or on returning from a temporary resting state, the control unit 17 causes the heat generating member 70 to generate heat for a brief time. The control unit 17 then starts rotation of the pressure roller 41. The viscosity of lubricant (grease or the like) that has been applied to the inner circumferential surface of the fixing belt 35 decreases due to the heat generated by the heat generating member 70. This improves the slidability between the fixing belt unit 40 and the fixing belt 35 at the start of rotation of the pressure roller 41.

The control unit 17 measures the temperature of the central part of the fixing belt 35 with the central belt thermometer 641. The control unit 17 measures the temperature of the −Y side end part on the of the fixing belt 35 with the end belt thermometer 642. The temperature of the −Y side end portion on the of the fixing belt 35 can be assumed to equal to the temperature of the +Y side end portion of the fixing belt 35. The control unit 17 measures the temperatures of the center portion and the end portion of the fixing belt 35 during the operation of the fixing device 30.

As described above, the control unit 17 controls the electric power supplied to the heat generating member 70 with the central triac 96 and the end triac 97. The control unit 17 controls the central heating element 171 power supply based on the temperature measurement result for the central part of the fixing belt 35. The controller 17 controls the first end heating element 172 and the second end heating element 173 power supply based on the temperature measurement result for an end part of the fixing belt 35.

The fixing device 30 according to the first embodiment includes the heater unit 43. The heater unit 43 includes a base 50, a first heat generator 71 provided on the first surface 501 side of the base 50, a first wiring portion 83 provided on the first surface 501 side of the base 50 and connected to the first heat generator 71, a first electrode group 81 provided on the first surface 501 side of the base 50 and supplying power to the first heat generator 71 via the first wiring portion 83, a second heat generator 72 provided on the second surface 502 side of the base 50, and a second electrode group 82 provided on the second surface 502 side of the base 50 and supplying power to the second heat generator 72 via the second wiring portion 84.

In the heater unit 43, the first wiring portion 83 (which connects the first heat generator 71 and the first electrode group 81) and the second wiring portion 84 (which connects the second heat generator 72 and the second electrode group 82) are disposed in a dispersed manner on both main surface sides of the base 50.

When the first wiring portion 83 and the second wiring portion 84 are distributed on both surfaces of the base 50 in this manner, the first wiring portion 83 and the second wiring portion 84 are not on the same surface of the base 50. Therefore, since the first wiring portion 83 and the second wiring portion 84 are not formed side by side in the short-side direction (X direction) of the base 50, the size of the base 50 in the short-side direction can be reduced.

According to the heater unit 43 of the first embodiment, even when a structure with a plurality of heating elements is adopted as the heat generating member 70, it is possible to reduce the dimension of the base 50 in the X direction.

According to the fixing device 30 of the first embodiment, since the heater unit 43 is provided, it is possible to reduce the size and cost of the fixing device. Furthermore, according to the image forming apparatus 1 of the first embodiment, since the small-sized fixing device 30 is provided, the image forming apparatus can be reduced in size than would otherwise be the case.

Second Embodiment

Next, an image forming apparatus according to a second embodiment will be described. The image forming apparatus of the second embodiment is different from the image forming apparatus of the first embodiment with regard to the configuration of the heater unit in the fixing device. In general, the other configurations in these embodiments are the same.

Figure 9:
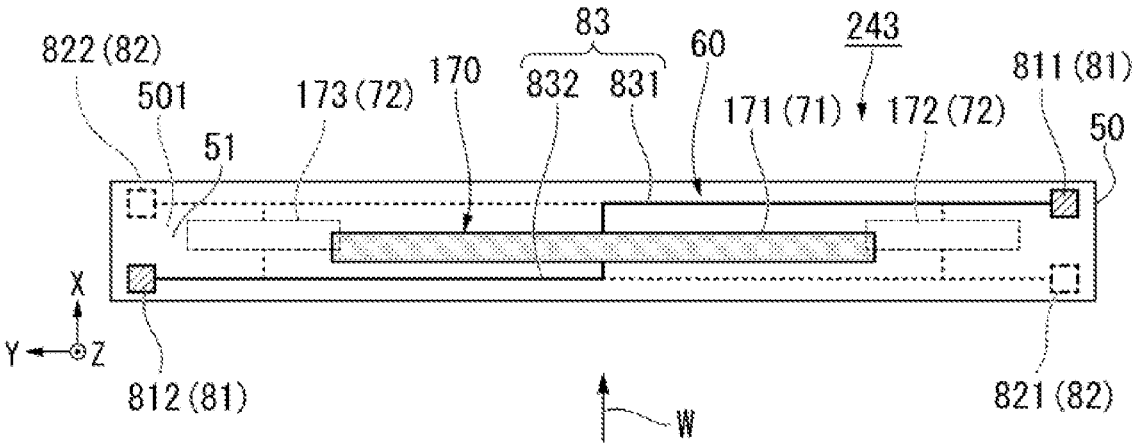
FIG. 9 is a top view of a heater unit according to a second embodiment.
Figure 10:
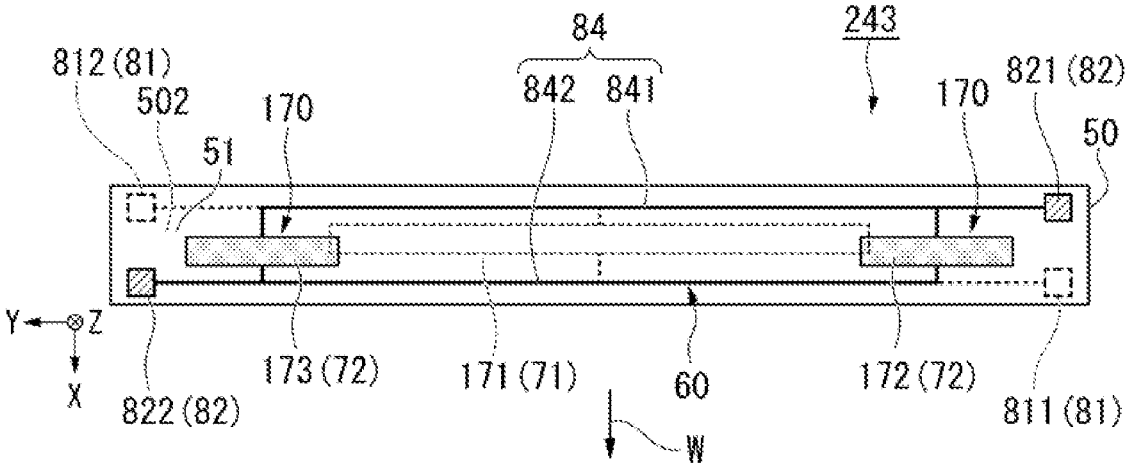
FIG. 10 is a bottom view of a heater unit according to a second embodiment.

FIGS. 9 and 10 are plan views of a heater unit 243 according to the second embodiment. FIG. 9 is a bottom view of the heater unit 243 viewed from the +Z side toward the −Z side, and FIG. 10 is a top view of the heater unit 243 viewed from the −Z side toward the +Z side.

As shown in FIGS. 9 and 10, the heater unit 243 includes a base 50, a heat generating member 170, and a wiring group 60. The heat generating member 170 includes a first heat generator 71 provided on the first surface 501 of the base 50 via the insulating layer 51, and a second heat generator 72 provided on the second surface 502 of the base 50 via the insulating layer 51.

When the heater unit 243 of the second embodiment is seen in a plan view, the first heat generator 71 and the second heat generator 72 partially overlap each other. The positions of the first heat generator 71 and the second heat generator 72 are partially offset from each other in the short-side direction (X direction) of the base 50. In the short-side direction of the base 50, the first heat generator 71 is located upstream of the second heat generator 72 in the conveyance direction W.

Since the sheet S expands somewhat when being heated, if the first heat generator 71 and the second heat generator 72 are heated at the same time, the entire heat generating member 70 in the width (Y direction) of the sheet S is simultaneously heated. Since sheet S also travels while being heated (expanded), damage such as wrinkles or curls may occur in the sheet S.

However, according to the heater unit 243 of the second embodiment, when heating the sheet S, the heating time of the first heat generator 71, which is positioned on the upstream side in the conveyance direction W, and the heating time of the second heat generator 72, which is positioned on the downstream side in the conveyance direction W, can be made different from each other. The first heat generator 71 heats the central part of the sheet S as it is conveyed, and the second heat generator 72 heats the end parts of the sheet S. Therefore, since the end parts of the sheet S pass by the heating elements of the heater unit 243 with a delay from the time at which the central part of the sheet S passes, it is possible to reduce potential damage such as wrinkles and curls generated in the sheet S with the heating as compared to a case where the entire sheet width is heated at the same time rather than with some delay between the different width portions.

Third Embodiment

Next, an image forming apparatus according to a third embodiment will be described. The image forming apparatus of the third embodiment is different from the image forming apparatus of the first embodiment in the configuration of the heater unit in the fixing device, however, the other configurations are substantially similar.

Figure 11:
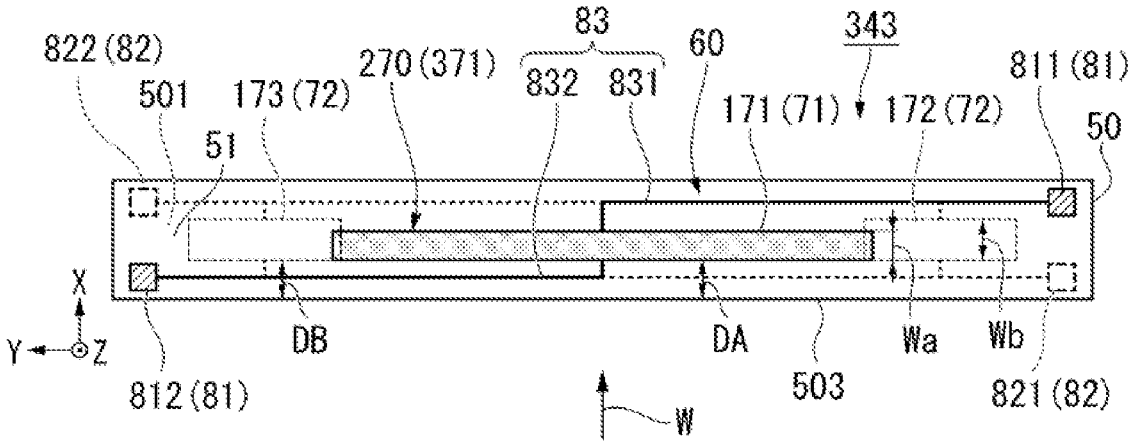
FIG. 11 is a top view of a heater unit according to a third embodiment.
Figure 12:
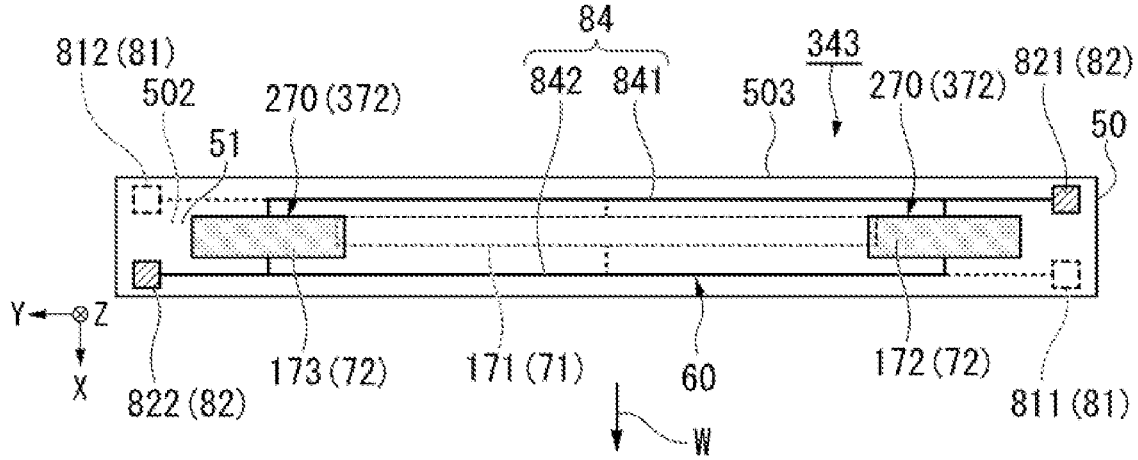
FIG. 12 is a bottom view of a heater unit according to a third embodiment.

FIGS. 11 and 12 are plan views of a heater unit 343 according to the third embodiment. FIG. 11 is a bottom view of the heater unit 343 viewed from the +Z side toward the −Z side. FIG. 12 is a top view of the heater unit 343 viewed from the −Z side toward the +Z side.

As shown in FIGS. 11 and 12, the heater unit 343 includes a base 50, a heat generating member 270, and a wiring group 60. The heat generating member 270 includes a first heat generator 371 provided on the first surface 501 of the base 50 via the insulating layer 51, and a second heat generator 372 provided on the second surface 502 via the insulating layer 51. The first heating unit 371 includes a central heating element 171. The second heat generator 372 includes a first end heating element 172 and a second end heating element 173.

When the heater unit 343 of the third embodiment is seen in a plan view, the first heat generator 371 and the second heat generator 372 partially overlap each other. The width Wa of the central heating element 171 of the first heat generator 371 in the short-side direction (X-direction) of the base 50 (corresponding to the conveyance direction W of the sheet S) is less than the width Wb of the first end heating element 172 and the second end heating element 173 of the second heat generator 372 in the short-side direction (X-direction) of the base 50. That is, the width Wa of the central heating element 171 that heats the central part of the sheet S is less than the width Wb of the first end heating element 172 and the second end heating element 173 that heat the end portions of the sheet S.

In general, when the sheet S is heated, heat from both end parts of the sheet S is more readily released outward towards unheated regions than heat from the center part of the sheet S due to the heating by the first end heating element 172 and the second end heating element 173. For this reason, in a case where the heat generation amounts of the central part and both end parts in the width direction of the sheet S are set to be the same, heating of the end parts of the sheet S might be insufficient, and failure to fix the toner may occur in the end regions.

However, according to the heater unit 343, by increasing the width in the conveyance direction W of the second heat generator 372 for both end portions of the sheet S relative to the central part, it is possible to increase the amount of heat generated for both end parts of the sheet S where heat more easily escapes as compared to the central part. Therefore, sufficiently heating the entire width of the sheet S, it is possible to prevent the occurrence of toner fixing failure by sufficiently heating the entire width of the sheet S by increasing the relative width of the end heating elements as compared to the central heating element.

In a plan view of the heater unit 343, the distance DA from the side 503 of the base 50 (upstream side in the conveyance direction W of the sheet S) to the first heat generator 371 is equal to the distance DB from the side 503 to the second heat generator 372.

In the third embodiment, in the plan view of the heater unit 343, the distance of the first heat generator 371 from the side 503 is equal to the distance of the second heat generator 372 from the side 503. According to the third embodiment, by aligning the first heat generator 371 and the second heat generator 372 at the same distance from the side 503, it is possible to reduce or limit the size of the base 50 by preventing X-dimension direction from becoming larger than necessary if the width Wa of the first heat generator 371 and the width Wb of the second heat generator 372 are made different from one another as described above.

Fourth Embodiment

Next, an image forming apparatus according to a fourth embodiment will be described. The image forming apparatus of the fourth embodiment is different from the image forming apparatus of the first embodiment in the configuration of the heater unit in the fixing device, and the other configurations are substantially similar. In the first embodiment, the case where the first heat generator 71 provided on the first surface 501 side of the base 50 includes only one heating element (the central heating element 171) was described as one possible example, but the first heat generator of the fourth embodiment includes a plurality of heating elements rather than a singular central heating element.

Figure 13:
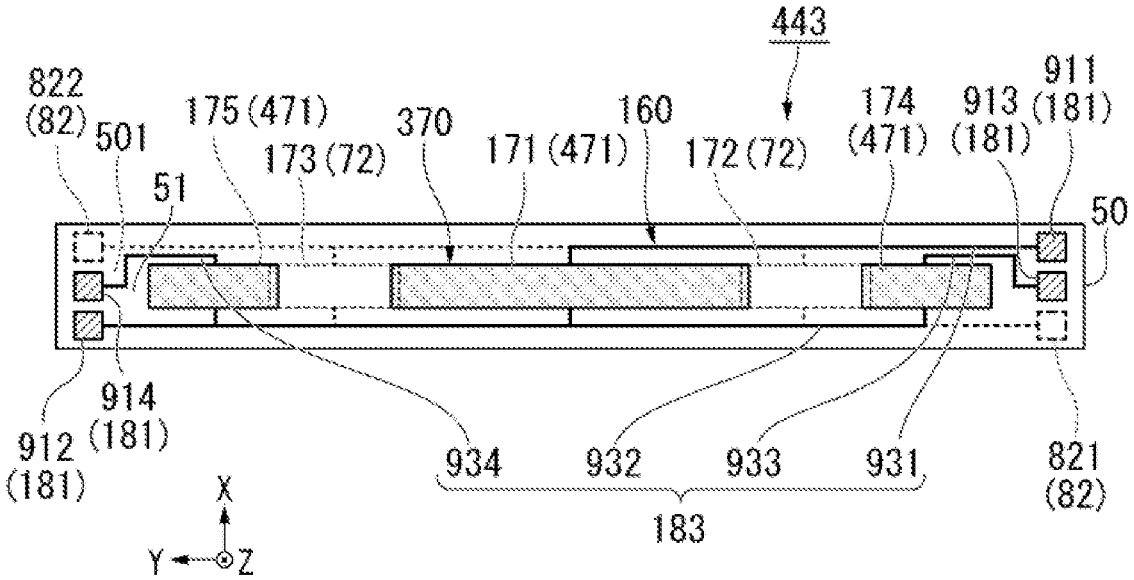
FIG. 13 is a top view of a heater unit according to a fourth embodiment.
Figure 14:
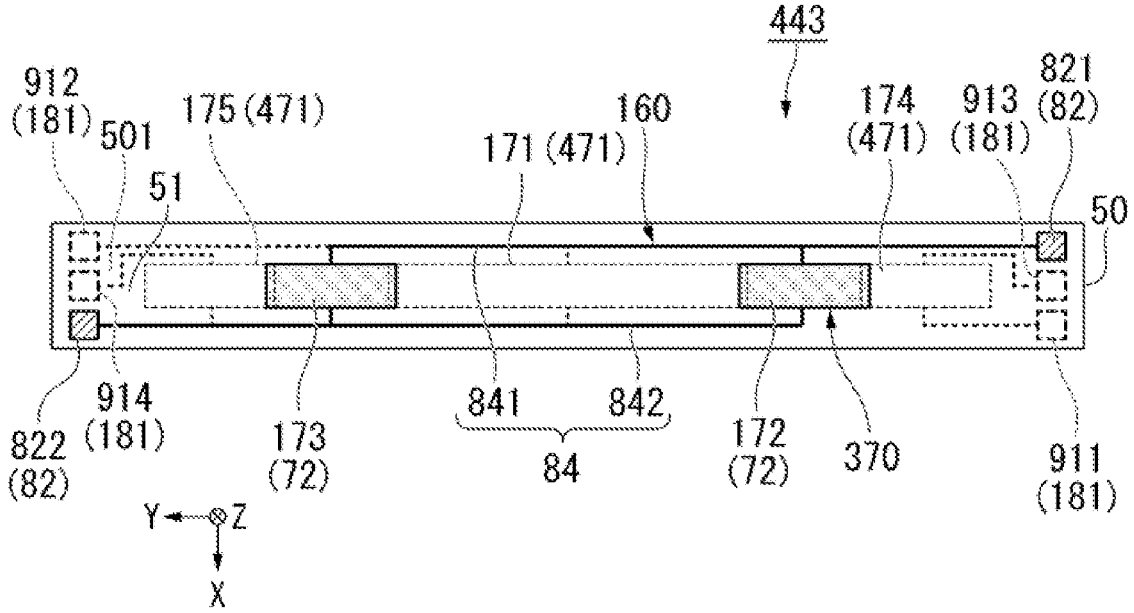
FIG. 14 is a bottom view of a heater unit according to a fourth embodiment.

FIGS. 13 and 14 are plan views of a heater unit 443 of the fourth embodiment. FIG. 13 is a top view of the heater unit 443 viewed from the +Z side toward the −Z side. FIG. 14 is a bottom view of the heater unit 443 viewed from the −Z side toward the +Z side.

As shown in FIGS. 13 and 14, the heater unit 443 includes a base 50, a heat generating member 370, and a wiring set 160. The heat generating member 370 includes a first heat generator 471 provided on the first surface 501 of the base 50 via the insulating layer 51, and a second heat generating portion 72 provided on the second surface 502 of the base 50 via the insulating layer 51.

The first heat generator 471 includes a central heating element 171, a third end heating element 174, and a fourth end heating element 175. The outer shape of each of the third end heating element 174 and the fourth end heating element 175 is a rectangular shape having a side (a longer side) along the Y direction and a side (a shorter side) along the X direction. The outer shapes of the third end heating element 174 and the fourth end heating element 175 match the outer shapes of the first end heating element 172 and the second end heating element 173 in the second heat generator 72, for example.

When the heater unit 443 is viewed in a plan view, the central heating element 171, the third end heating element 174, and the fourth end heating element 175 are disposed along the longitudinal direction of the base 50. The third end heating element 174 is provided on the −Y side of the central heating element 171, and the fourth end heating element 175 is provided on the +Y side of the central heating element 171. The first end heating element 172 is located between the central heating element 171 and the third end heating element 174 in the longitudinal direction of the base 50. The second end heating element 173 is positioned between the central heating element 171 and the fourth end heating element 175 in the longitudinal direction of the substrate.

The wiring set 160 includes a first electrode group 181, a second electrode group 82, a first wiring portion 183, and a second wiring portion 84. The first electrode group 181 and the first wiring portion 183 are provided on the first surface 501 of the base 50 via the insulating layer 51.

The first electrode group 181 includes a central positive electrode 911, a common electrode 912, a first end positive electrode 913, and a second end positive electrode 914. The central positive electrode 911 is disposed at the end parts of the base 50 on the −Y side and the +X side. The first end positive electrode 913 is disposed on the base 50 so as to be adjacent to the central positive electrode 911 on the −X side. The common electrode 912 is disposed at the end parts on the +Y side and the −X side of the base 50. The second end positive electrode 914 is disposed on the base 50 so as to be adjacent to the common electrode 912 on the +X side.

The first wiring portion 183 includes a central positive wiring 931, a common wiring 932, a first end positive wiring 933, and a second end positive wiring 934. The central positive wiring 931 connects the central heating element 171 and the central positive electrode 911. The common wiring 932 connects the central heating element 171, the third end heating element 174, and the fourth end heating element 175 to the common electrode 912. The first end positive wiring 933 connects the third end heating element 174 and the first end positive electrode 913. The second end positive wiring 934 connects the fourth end heating element 175 and the second end positive electrode 914.

In a plan view of the heater unit 443, the first heat generator 471 and the second heat generator 72 partially overlap each other.

The first end heating element 172, the third end heating element 174, and the central heating element 171 partially overlap each other in the longitudinal direction of the base 50. The second end heating element 173, the fourth end heating element 175, and the central heating element 171 partially overlap each other in the longitudinal direction of the base 50. The overlapping amounts of the heating elements are equal to each other.

In the heater unit 443, the first heat generator 471 and the second heat generator 72 are disposed in an overlapping state, and thus it is possible to prevent a temperature drop at the boundary between the heat generators 471 and 72. The amount of overlap in this case is, for example, preferably less than or equal to 10 mm, more preferably less than or equal to 5 mm.

In a plan view of the heater unit 443, the first electrode group 181 and the second electrode group 82 are disposed at positions not overlapping each other. In the fourth embodiment, the central positive electrode 911, the common electrode 912, the positive electrode 821, and the common electrode 822 are disposed at corners of the base 50. The first end portion positive electrode 913 is disposed between the central positive electrode 911 and the positive electrode 821 when the heater unit 443 is viewed in a plan view. The second end positive electrode 914 is disposed between the common wiring 932 and the common electrode 822 when the heater unit 443 is viewed in a plan view.

In the heater unit 443, the first wiring portion 183, which connects the first heat generator 471 and the first electrode group 181, and the second wiring portion 84, which connects the second heat generator 72 and the second electrode group 82, are disposed in a distributed manner on both surfaces of the base 50.

When the first wiring portion 183 and the second wiring portion 84 are distributed on both sides of the base 50 in this manner, the first wiring portion 183 and the second wiring portion 84 are not formed on the same surface of the base 50. Therefore, since the first wiring portion 183 and the second wiring portion 84 are not formed side by side in the short-side direction (X direction) with each other, the dimension of the base 50 in the short-side direction can be reduced.

According to the fourth embodiment, even when the first heat generator 471 provided on the first surface 501 includes a plurality of heat generating elements, it is possible to reduce the increase in the dimension of the base material 50 in the side direction (X direction). Therefore, a fixing device including a heater unit 443 or an image forming apparatus including such a fixing device can be reduced in size than might otherwise be the case.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A heater unit, comprising:

a substrate having a first surface side and a second surface side on opposite surfaces of the substrate separated in a thickness direction;

a first heating element on the first surface side of the substrate, the first heating element extending in a first direction along the first surface side and having a first end portion and a second end portion spaced from each other at a first distance in the first direction; and a second heating element on the second surface side of the substrate, the second heating element extending in the first direction along the second surface side of the substrate and having a first end portion and a second end portion spaced from each other at a second distance in the first direction, wherein the first heating element has a width in a second direction that is perpendicular to the first direction and the thickness direction of the substrate, the second heating element has a width in the second direction, and a midpoint of the width of the first heating element and a midpoint of the width of the second heating element are offset from one another in position along the second direction.

2. The heater unit according to claim 1, further comprising:

a first wiring on the first surface side of the substrate and connected to the first heating element.

3. The heater unit according to claim 1, further comprising:

a first electrode on the first surface side of the substrate and connected to the first heating element.

4. The heater unit according to claim 1, further comprising:

a second wiring on the second surface side of the substrate and connected to the second heating element.

5. The heater unit according to claim 1, further comprising:

a second electrode on the second surface side of the substrate and connected to the second heating element.

6. The heater unit according to claim 1, wherein the second end portion of the second heating element overlaps the first end portion of the first heating element along the thickness direction of the substrate.

7. The heater unit according to claim 1, wherein the second heating element extends in the first direction to a position on the second surface side of the substrate that is beyond the first heating element.

8. The heater unit according to claim 1, wherein the second heating element overlaps less than 10 mm along the first direction of the first heating element as viewed in the thickness direction of the substrate.

9. The heater unit according to claim 1, wherein the first and second heating elements each have a maximum width in the second direction that is equal to the other.

10. The heater unit according to claim 1, wherein the first heating element has a maximum width in the second direction that is less than a maximum width of the second heating element in the second direction.

11. The heater unit according to claim 10, wherein an outer edge of the first heating element is aligned with an outer edge of the second heating element.

12. The heater unit according to claim 1, further comprising:

a third heating element on the second surface side of the substrate, wherein a portion of the third heating element overlaps the second end portion of the first heating element.

13. The heater unit according to claim 1, further comprising:

a first electrode on the first surface side of the substrate and connected to the first heating element; and a second electrode on the second surface side of the substrate and connected to the second heating element, wherein the first electrode is on a first corner portion of the substrate, and the second electrode is on a second corner portion of the substrate.

14. The heater unit according to claim 1, further comprising:

a first wiring on the first surface side of the substrate and connected to the first heating element;

an insulating layer between the first heating element and the substrate; and a protective coating covering the first heating element and the first wiring.

15. The heater unit according to claim 1, wherein the first end portion of the first heating element is an outermost end portion in the first direction.

16. The heater unit according to claim 15, wherein the first heating element has a maximum width in the second direction that is less than a maximum width of the second heating element in the second direction.

17. The heater unit according to claim 1, wherein an outer edge of the first heating element is aligned with an outer edge of the second heating element.

18. The heater unit according to claim 1, wherein the first heating element has a maximum width in the second direction that is equal to a maximum width in the second direction of the second heating element.

19. The heater unit according to claim 1, further comprising:

a second wiring on the second surface side of the substrate and connected to the second heating element; and a third heating element on the second surface side of the substrate and connected to the second wiring, wherein a portion of the third heating element overlaps the second end portion of the first heating element along the thickness direction.

20. The heater unit according to claim 1, further comprising:

a first wiring on the first surface side of the substrate and connected to the first heating element; and a second wiring on the second surface side of the substrate and connected to the second heating element, wherein the second wiring partially overlaps the first wiring along the thickness direction of the substrate.

* * * * *